United States Patent [19]

Horsch

[11] Patent Number: 4,661,036

[45] **Date of Patent: * Apr. 28, 1987**

[54] BACKHOE HYDRAULIC LATCH ARRANGEMENT

[75] Inventor: Rudolf Horsch, Davenport, Iowa

[73] Assignee: J. I. Case Company, Racine, Wis.

[ * ] Notice: The portion of the term of this patent subsequent to Apr. 22, 2003 has been disclaimed.

[21] Appl. No.: 625,676

[22] Filed: Jun. 28, 1984

[51] Int. Cl.[4] ..... E02F 3/34

[52] U.S. Cl. ..... 414/686; 172/272; 172/274; 212/175; 212/185; 212/189; 280/461 A; 403/152; 403/161; 414/723

[58] Field of Search ..... 414/686, 708, 723, 724; 403/100, 152, 161, 163; 212/175, 185, 188, 189; 37/117.5; 172/272–275; 280/461, 461 A, 415 R, 759

[56] References Cited

U.S. PATENT DOCUMENTS

| | | | |
|---|---|---|---|
| 2,961,102 | 11/1960 | Pitman | 212/189 |
| 3,298,724 | 5/1964 | Coleman et al. . | |
| 3,362,548 | 1/1968 | Cunningham | 212/189 X |
| 3,844,425 | 10/1974 | Bailey . | |
| 3,896,884 | 7/1975 | Casey . | |
| 4,034,998 | 7/1977 | Iijima et al. | 414/686 X |
| 4,142,642 | 3/1979 | Myers | 414/686 X |
| 4,208,162 | 6/1980 | Neitzel | 414/686 |
| 4,242,034 | 12/1980 | Schmitz . | |
| 4,355,945 | 10/1982 | Pilch | 414/686 |
| 4,583,906 | 4/1986 | Frisbee | 414/686 |

*Primary Examiner*—Robert J. Spar
*Assistant Examiner*—Lyle Kimms
*Attorney, Agent, or Firm*—Dressler, Goldsmith, Shore, Sutker & Milnamow

[57] ABSTRACT

A hydraulic latch arrangement is disclosed for facilitating efficient movement of a backhoe between working and transport positions relative to an associated material handling implement upon which the backhoe is mounted. The arrangement includes an upper pivot which pivotally connects the frame of the backhoe to the implement for relative movement of the backhoe about a horizontal axis. The arrangement further includes a pivotally movable latch member preferably mounted on the associated implement, and a latch pin mounted on the backhoe frame for cooperation with the pivotal latch member. A hydraulic latch motor is provided for selectively moving the pivotal latch member between engaged and disengaged positions, wherein in the engaged position the latch member cooperates with the latch pin for effecting a substantially rigid connection between the backhoe and the associated implement. In the preferred embodiment, hydraulic fluid conduits are provided which interconnect the hydraulic latch motor with one of the hydraulic rams which operates one of the stabilizers of the backhoe, thus permitting operation of the latch motor attendant to selective fluid pressurization of the stabilizer hydraulic ram.

2 Claims, 4 Drawing Figures

BACKHOE HYDRAULIC LATCH ARRANGEMENT

TECHNICAL FIELD

The present invention relates generally to arrangements for mounting a backhoe on a material handling implement, and more particularly to a hydraulically-operated backhoe latch arrangement for selectively effecting connection and disconnection of a backhoe with an associated implement.

BACKGROUND OF THE INVENTION

One of the most versatile types of material handling equipment is a hydraulically-operated backhoe. This type of device can be very efficiently used for effecting a wide variety of digging operations and the like. In this regard, it is always desirable for such equipment to be configured for both reliable and efficient operation by minimizing non-productive "down time" of the equipment.

One manner in which efficient operation of such material handling equipment is promoted is to configure the equipment for convenient transport from one work area to another. Transport of a backhoe is usually accomplished by driving the material handling implement, such as a tractor, upon which the backhoe is mounted from one work area to another. In order to position the backhoe in an out-of-the-way disposition during such transport, a pivotal mounting is provided between the backhoe and the associated implement so that the backhoe can be pivoted generally upwardly and toward the implement. The backhoe is thus movable from its ordinary lowered working position to its so-called "transport" position.

Naturally, the interconnection between the backhoe and the associated implement must be as rigid as possible during operation of the backhoe, and thus a suitable latching or locking arrangement must be provided for releasably maintaining the backhoe in its working position. In order to promote efficiency in use of the backhoe, the present invention contemplates a hydraulically-operated latching arrangement for selectively maintaining the backhoe in its lowered, working position with respect to the associated implement.

SUMMARY OF THE INVENTION

A hydraulic latch arrangement embodying the principles of the present invention is disclosed for connecting a backhoe to an associated material handling implement, such as a tractor or the like. In accordance with a typical construction, the backhoe includes a frame and an articulable boom assembly pivotally mounted on the frame. Stability is provided during material handling operations by the provision of a pair of vertically movable stabilizer arms respectively positioned at generally laterally opposite sides of the backhoe frame, with a pair of stabilizer hydraulic rams further provided for effecting selective raising and lowering of the stabilizer arms.

The present latch arrangement includes an upper pivot which pivotally connects the backhoe frame and the implement for movement of the backhoe relative to the implement about a horizontal axis. The upper pivot accommodates movement of the backhoe between its lowered working and raised transport positions.

The present latch arrangement further includes a first latch member movably mounted on one of the implement and the backhoe frame for movement between engaged and disengaged positions. A second latch pin member is preferably mounted on the other of the implement and the backhoe frame for cooperation with the latch member. Thus, in the engaged position of the latch member, the latch pin is adapted to be retained thereby to hold the backhoe against movement with respect to the implement. In the disengaged position of the latch member, the latch pin is released from the latch member to permit pivotal movement of the backhoe relative to the implement about the horizontal axis.

In the illustrated embodiment, the latch member is pivotally movably mounted on the implement in a disposition generally below the upper pivot of the arrangement. The latch member is provided with a generally downwardly-open hook-shaped configuration, and is thus adapted to cooperate with the latch pin mounted on the backhoe frame.

In accordance with the present invention, movement of the latch member between its engaged and disengaged positions is effected hydraulically. To this end, a hydraulic latch motor, preferably comprising a double-acting hydraulic fluid ram, is operatively connected to the latch member for selectively moving the member between engaged and disengaged positions. As will be appreciated, hydraulic operation of the latch arrangement permits the backhoe to be very conveniently and efficiently moved between its working and transport positions.

While the hydraulic latch motor can be readily operated by the provision of a suitable hydraulic fluid valve, the present invention contemplates that hydraulic fluid conduits be provided for joining the latch motor in fluid communication with one of the backhoe stabilizer fluid rams. In this manner, selective fluid pressurization of the stabilizer hydraulic ram effects operation of the hydraulic latch motor for moving the pivotal latch member between engaged and disengaged positions. This construction is desirably straightforward for reliability as well as economy of manufacture and maintenance.

In the preferred form, the hydraulic fluid conduits between the latch motor and the stabilizer ram are configured such that pressurization of the stabilizer ram for lowering of the associated stabilizer arm effects operation of the hydraulic latch motor such that the pivotal latch member is moved toward its engaged position. A selectively operable shut-off valve is further preferably provided in operative connection with the hydraulic fluid conduits for isolating the hydraulic latch motor from the stabilizer hydraulic ram to permit operation of the stabilizer ram without operation of the latch motor.

Numerous other features and advantages of the present invention will become readily apparent from the following detailed description, the accompanying drawings, and the appended claims.

DETAILED DESCRIPTION

Figure 1:
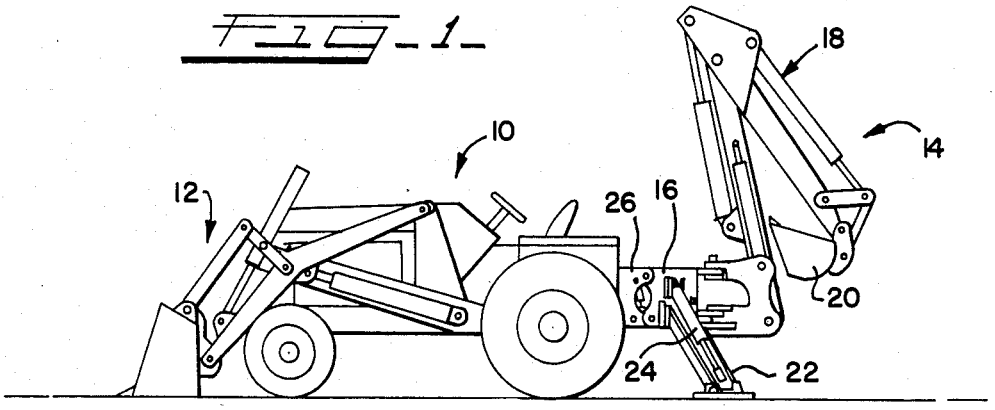
FIG. 1 is a side elevational view of a material handling implement, shown as a tractor, having a backhoe mounted thereon with a hydraulic latch arrangement embodying the principles of the present invention.

While the present invention is susceptible of embodiment in various forms, there is shown in the drawings and will hereinafter be described a presently preferred embodiment, with the understanding that the present disclosure is to be considered as an exemplification of the invention, and is not intended to limit the invention to the specific embodiment illustrated.

With reference first to FIG. 1, therein is illustrated a material handling implement shown as a tractor 10, having a front end loader 12 and a backhoe 14 mounted thereon. As will be recognized by those familiar with the art, backhoe 14 is shown in a generally typical configuration, including a backhoe frame 16 which pivotally supports an articulable boom assembly 18 for effecting material handling operations with a bucket 20 mounted on the free end of the boom assembly.

In order to provide desired stability during operation of the backhoe, the backhoe includes a pair of vertically movable stabilizer arms 22 (one being shown) which are pivotally mounted on respective laterally opposite sides of backhoe frame 16. A stabilizer hydraulic fluid ram 24 (one shown) is provided for each of the stabilizer arms for effecting raising and lowering movement of the arms so that a wide "stance" can be established for stability during digging or the like.

Figure 2:
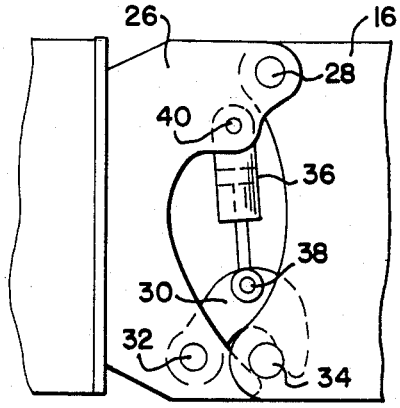
FIG. 2 is an enlarged side elevational view illustrating the hydraulic latch arrangement shown in FIG. 1 in an engaged disposition.
Figure 3:
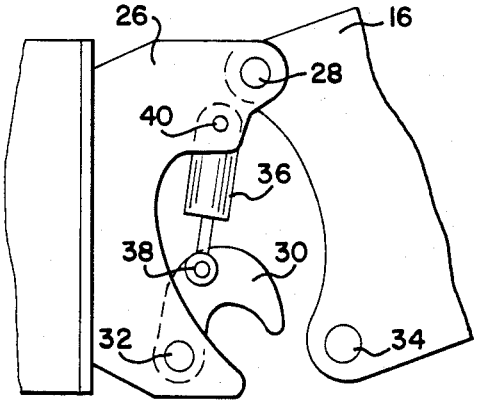
FIG. 3 is a side elevational view similar to FIG. 2 illustrating the present hydraulic latch arrangement in a disengaged disposition.

Referring now to FIGS. 2 and 3, therein is illustrated the hydraulic latch arrangement embodying the principles of the present invention. As will be recognized, the present latch arrangement is desirably straightforward in construction for both reliability and economy, and is arranged so as to permit a rigid yet releasable connection between backhoe frame 16 and a rearwardly disposed implement mount 26 of tractor 10.

To permit movement of the backhoe 14 between its lowered working and raised transport positions, the present latch arrangement includes an upper pivot pin 28 which pivotally connects implement mount 26 and backhoe frame 16 for movement of backhoe 14 relative to tractor 10 about a horizontal axis. If desired, pivot pin 28 can be configured for removal from the backhoe frame and the implement mount to permit the backhoe to be completely detached from the tractor 10.

The present latch arrangement further includes a first latch member movably mounted on one of the implement mount 26 and the backhoe frame 16, and a second latch pin member preferably provided on the other of the implement mount and the backhoe frame for cooperation with the movable latch member. To this end, a first latch member 30 having a generally downwardly open, hook-shaped configuration is provided generally below upper pivot pin 28, and is pivotally connected to implement mount 26 by a latch pivot 32 for relative movement about another horizontal axis parallel to the horizontal axis defined by upper pivot pin 28.

A second latch pin member 34 is preferably provided on backhoe frame 16, and is configured for cooperation with the hook-shaped latch member 30. As best shown in FIGS. 2 and 3, the latch member 30 is selectively pivotally movable from an engaged position (FIG. 2) wherein the latch pin 34 is securely retained by the latch member 30 for maintaining backhoe 14 in its lowered working position, to a disengaged position (FIG. 3) wherein the latch pin 34 is released from the latch member 30 to permit relative movement of backhoe 14 with respect to tractor 10 about the horizontal axis defined by upper pivot pin 28. Thus, in the engaged position of the latch member 30, the present latch arrangement provides an essentially fixed connection between the backhoe 14 and the tractor 10. In contrast, movement of the latch member 30 to its disengaged position releases the latch pin 34 so that the backhoe 14 is readily movable to its raised transport position.

Highly efficient and convenient operation of the present latch arrangement is provided by a hydraulic latch motor 36 which is operatively connected to the pivotal latch member 30. Latch motor 36, which preferably comprises a double-acting hydraulic fluid ram, is pivotally connected to latch member 30 at pivot 38, with the opposite end of the motor pivotally connected to implement mount 26 at pivot 40. Thus, selective fluid pressurization of latch motor 30 effects pivotal movement of the latch member 30 between its engaged and disengaged positions.

If desired, selective fluid pressurization of latch motor 36 can be readily accommodated by the provision of a suitable manually operable hydraulic valve for directing pressurized hydraulic fluid from the hydraulic system of the tractor 10. However, FIG. 4 schematically illustrates a preferred arrangement for effecting pressurization of the latch motor 36 by way of the existing hydraulic components provided for operation of one of the stabilizer hydraulic rams 24 of the backhoe 14.

Figure 4:
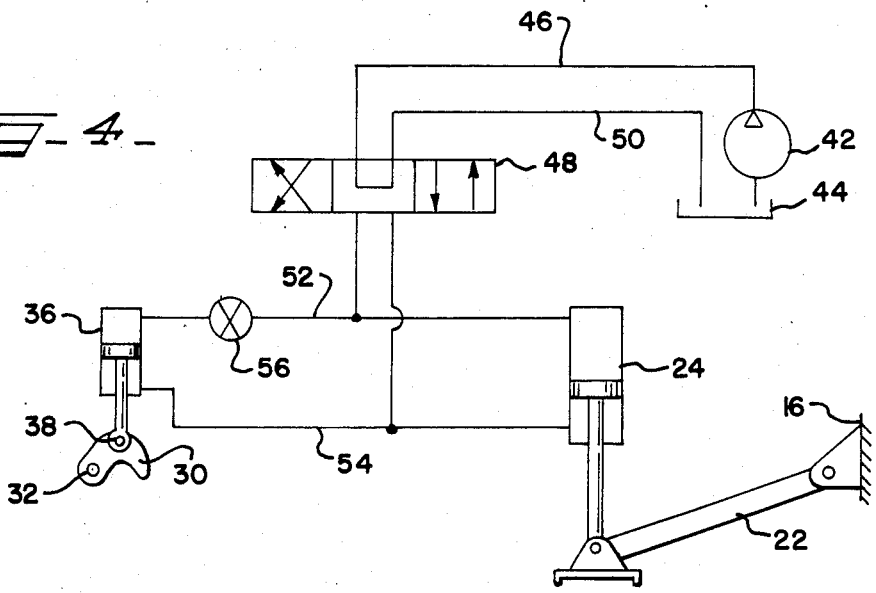
FIG. 4 is a schematic diagram illustrating the hydraulic system for effecting operation of the present latch arrangement.

FIG. 4 illustrates a hydraulic fluid pump 42 which typically is provided on tractor 10 for effecting hydraulic operation of backhoe 14 as well as other hydraulically-operated components. Hydraulic pump 42 draws hydraulic fluid from a fluid reservoir 44, and directs pressurized hydraulic fluid through a conduit 46 to a selectively positionable hydraulic valve 48. Return fluid flow from the valve 48 to the reservoir 44 is provided by a conduit 50. As will be recognized, FIG. 4 illustrates a simplified form of such a typical pressurized hydraulic fluid supply system.

The hydraulic valve 48 is selectively positionable for effecting operation of stabilizer hydraulic ram 24, and thus selective raising and lowering of the associated stabilizer arm 22. To this end, the valve 48 is joined in fluid communication with a pair of hydraulic fluid conduits 52 and 54 which are respectively connected with the so-called head end and rod end of stabilizer hydraulic ram 24. Thus, selective positioning of the valve 48 effects raising and lowering of the stabilizer arm 22.

Notably, hydraulic fluid conduits 52 and 54 join in fluid communication the hydraulic latch motor 36 and the stabilizer hydraulic ram 24. Thus, selective fluid pressurization of stabilizer hydraulic ram 24 effects pressurization of latch motor 36 for movement of latch member 30 between its engaged and disengaged positions. By the arrangement shown in FIG. 4, it will be noted that the positioning of valve 48 for operating stabilizer ram 24 to lower stabilizer arm 22 acts to operate latch motor 36 for movement of latch member 30 toward its engaged position (FIG. 2). This is desirable since a rigid interconnection of the backhoe 14 and the tractor 10 is desired during use of the backhoe, at which time the stabilizers are ordinarily lowered. In contrast, positioning of valve 48 for operating stabilizer ram 24 for raising stabilizer arm 22 effects operation of latch motor 36 for movement of latch member 30 toward its disengaged position (FIG. 3).

Since it is sometimes desirable to operate the backhoe 14 without the backhoe stabilizers being lowered, a selectively operable shut-off valve 56 is preferably operatively connected with at least one of interconnecting conduits 52 and 54. The shut-off valve 56 is shown in operative association with the conduit 52, with the valve 56 being movable to a closed condition wherein latch motor 36 is hydraulically isolated from stabilizer ram 24. In this manner, valve 48 can first be positioned for operating latch motor 36 (with valve 56 in an open condition) so that latch member 30 engages and retains the latch pin 34 on the backhoe frame 16. Shut-off valve 56 can then be closed, and valve 48 again positioned for operation of stabilizer ram 24 as desired (such as for raising stabilizer arm 22) without attendant operation of latch motor 36.

From the foregoing, it will be observed that numerous modifications and variations can be effected without departing from the true spirit and scope of the novel concept of the present invention. It is to be understood that no limitation with respect to the specific embodiment disclosed herein is intended or should be inferred. It is, of course, intended to cover by the appended claims all such modifications as fall within the scope of the claims.

What is claimed is:

1. A hydraulic latch arrangement for connecting a backhoe to a material handling implement, wherein said backhoe includes a frame and vertically movable stabilizer means operable by stabilizer hydraulic ram means, said latch arrangement comprising:

upper pivot means pivotally connecting said backhoe frame and said implement for movement of said backhoe relative to said implement about a horizontal axis;

latch means pivotally mounted on said implement generally below said upper pivot means for pivotal movement between engaged and disengaged positions;

latch pin means mounted on said backhoe frame for cooperation with said latch means, whereby in said engaged position of said latch means said latch pin means is adapted to be received and retained by said latch means to hold said backhoe against movement with respect to said implement, and in said disengaged position of said latch means said latch pin means is released from said latch means to permit pivotal movement of said backhoe relative to said implement about said horizontal axis;

hydraulic latch motor means operatively connected to said latch means for selectively moving said latch means between said engaged and disengaged positions;

hydraulic control valve means operable by the operator of said implement for selectively controlling fluid pressurization of said stabilizer hydraulic ram means with pressurized hydraulic fluid from an associated source for selectively raising and lowering said vertically movable stabilizer means; and hydraulic fluid conduit means joining said hydraulic latch motor means, said stabilizer hydraulic ram means, and said hydraulic control valve means in fluid communication, whereby selective fluid pressurization of said stabilizer hydraulic ram means by operation of said control valve means for lowering said stabilizer means effects operation of said hydraulic latch motor means for moving said latch means toward said engaged position so that said latch pin means is received and retained by said latch means to hold said backhoe against movement with respect to said implement, and fluid pressurization of said stabilizer hydraulic ram means by operation of said control valve means for raising said stabilizer means effects operation of said hydraulic latch motor means for moving said latch means toward said disengaged position.

2. A hydraulic latch arrangement for a backhoe in accordance with claim 1, including selectively operable shut-off valve means operatively connected to said fluid conduit means for isolating said hydraulic latch motor means from said stabilizer hydraulic ram means to permit operation of said stabilizer hydraulic ram means without operation of said hydraulic latch motor means.

* * * * *